US005125689A

United States Patent [19]

Heninger

[11] Patent Number: 5,125,689

[45] Date of Patent: Jun. 30, 1992

[54] PACKAGE FOR PROMOTIONAL OR OTHER ARTICLES SUCH AS LOTTERY TICKETS

[75] Inventor: Byrne E. Heninger, Gainesville, Ga.

[73] Assignee: Dittler Brothers, Incorporated, Atlanta, Ga.

[21] Appl. No.: 703,683

[22] Filed: May 21, 1991

[51] Int. Cl.[5] ..... B42D 15/00

[52] U.S. Cl. ..... 283/106; 283/103; 273/139

[58] Field of Search ..... 283/106, 101, 103, 901, 283/105; 273/139

[56] References Cited

U.S. PATENT DOCUMENTS

| | | | |
|---|---|---|---|
| 1,983,004 | 12/1934 | Rowland . | |
| 3,512,780 | 5/1970 | Allison . | |
| 4,033,611 | 7/1977 | Johnsen . | |
| 4,099,721 | 7/1978 | Logander | 283/106 |
| 4,551,373 | 11/1985 | Conlon . | |
| 4,703,933 | 11/1987 | Cahill et al. . | |
| 4,778,153 | 10/1988 | Bachman et al. . | |

FOREIGN PATENT DOCUMENTS

| | | |
|---|---|---|
| 434105 | 4/1948 | Italy . |
| 172389 | 11/1933 | Switzerland . |
| 1311033 | 3/1973 | United Kingdom . |
| 1311034 | 3/1973 | United Kingdom . |
| 1459343 | 12/1976 | United Kingdom . |
| 1540639 | 2/1979 | United Kingdom . |

*Primary Examiner*—P. W. Echols
*Assistant Examiner*—William Fridie, Jr.
*Attorney, Agent, or Firm*—Kilpatrick & Cody

[57] ABSTRACT

Packages for sets of promotional or other articles (such as lottery tickets or coupons) which conceal information included on the articles, and methods of forming the packages, are disclosed. Embodiments of the package include even (or odd) numbers of integrated panels of equal size, pairs of which panels are separated by fold lines. A four-panel package may be folded along the first and third fold lines so that the inner face of each panel contacts the inner face of an adjacent panel. The package then may be folded along the second fold line so that the exposed outer faces of the remotest panels contact, thereby forming a package having the length and width of a single panel. Sets of tickets or articles equal to the number of panels (or multiples thereof) may then be formed simultaneously by creating areas in the folded package completely defined by lines of weakness. To separate the tickets from the remainder of the package and reveal the concealed information, the customer merely tears, or "punches out," the tickets along the lines of weakness.

13 Claims, 1 Drawing Sheet

PACKAGE FOR PROMOTIONAL OR OTHER ARTICLES SUCH AS LOTTERY TICKETS

This invention relates to packaging for promotional or other articles and more particularly to sets of tickets concurrently detachable from an integrated package to reveal information which was previously concealed by the arrangement of tickets within the package.

BACKGROUND OF THE INVENTION

A variety of overlays exist to mask individual promotional materials, including single lottery tickets, prior to a specific event such as purchase of the tickets. U.S. Pat. No. 3,512,780, for example, discloses a three-panel coupon blank folded twice and adhered to conceal between first and second panels a single puzzle piece contained on the third panel. The piece may be revealed by tearing interconnecting lines of weakness formed parallel to three edges of each panel and then unfolding the blank along the fold line which forms a common edge of the first and second panels. Only then may the piece be removed from the blank by tearing its surrounding lines of weakness.

British Patent Specification No. 1,459,343 discloses a paper article having upper and lower sections adhered at their peripheries, the upper section of which includes lines of weakness defining a single, multi-panel lottery ticket. Information printed on the face of the ticket adjacent the lower section is concealed until the ticket is removed by tearing the upper section along the lines of weakness. Rather than being scored (perforated), however, at least one edge of each panel must remain connected to a corresponding edge of an adjacent panel or panels. The unscored lower section, moreover, remains intact during the ticket removal process.

U.S. Pat. No. 4,788,153, commonly assigned to Dittler Brothers, Incorporated, illustrates in FIGS. 29–32 a single, three-panel promotional article in which initially non-adjacent first and third panels contain scored, separately removable sections. The scored sections overlay one another when the article is folded and, when removed, (ultimately) reveal concealed information or indicia contained on the second panel. The second panel contains no lines of weakness, however, and is designed to remain intact even after the concealed information is revealed.

SUMMARY OF THE INVENTION

The present invention provides a means to package sets of promotional or other articles, such as coupons or lottery tickets, and conceal information included thereon until the articles are removed, typically concurrently, from the package. In one embodiment of the invention, the package includes four integrated panels of equal size, pairs of which panels are separated by first, second, and third fold lines. The package may be folded along the first and third fold lines so that the inner face of each panel contacts the inner face of an adjacent panel. Folding in this manner conceals information printed or otherwise contained on the inner faces. The package then may be folded along the second fold line so that the exposed outer faces of the remotest panels contact, thereby forming a package having the length and width of a single panel. Placing adhesive around the peripheries of appropriate inner and outer faces permits the information to remain concealed until the package is opened. Crimping or knurling the periphery of the folded package provides additional security against tampering.

Sets of tickets or promotional articles equal to the number of panels (or multiples thereof) may then be formed simultaneously by creating area in the folded package completely defined by lines of weakness. To separate the tickets from the remainder of the package and reveal the concealed information, the customer merely tears, or "punches out," the tickets along the lines of weakness. Other embodiments of the invention include packages formed of even numbers of panels greater than four (or odd numbers of panels greater than or equal to three), providing an almost infinite variety of tickets or promotional articles available in the same package.

It is therefore an object of the present invention to provide a package containing multiple tickets or promotional or other articles.

It is an additional object of the present invention to provide a package for concealing information printed (or otherwise placed) on the articles until a specific event such as purchase of the package occurs.

It is another object of the present invention to provide a package permitting the articles to be removed concurrently.

It is yet another object of the present invention to provide a package in which lines of weakness defining each article may be formed simultaneously.

Other objects, features, and advantages of the present invention will become apparent with reference to the remainder of the written portion and drawings of this application.

DETAILED DESCRIPTION

Figure 1:
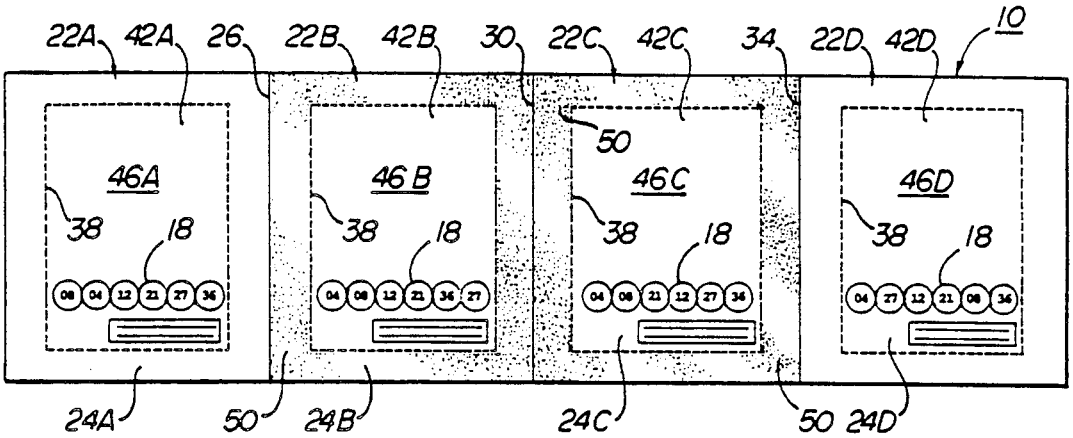
FIG. 1 is a plan view of the inner surface of the strip used to form the package of the present invention.
Figure 2:
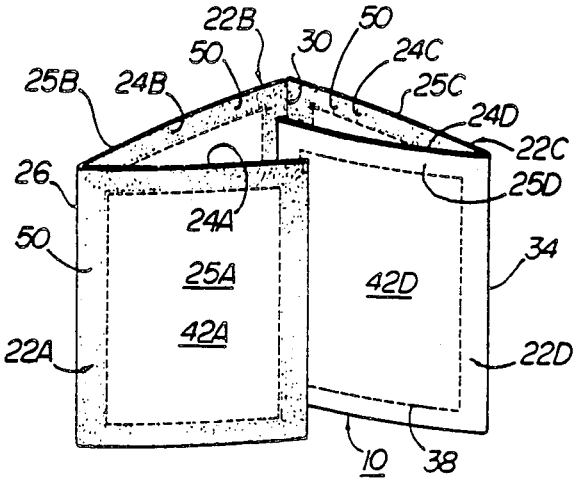
FIG. 2 is a perspective view of the strip of FIG. 1.
Figure 3:
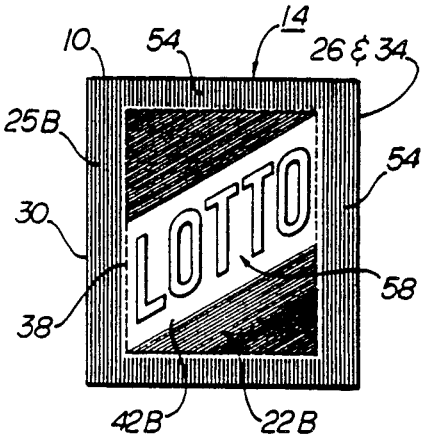
FIG. 3 is a plan view of the strip of FIG. 1 formed into the package of the present invention.

FIGS. 1–3 detail an embodiment of strip 10 used to form package 14 of the present invention. Strip 10 may be any elongated, opaque material such as paper, foil, or a laminated, multi-ply composite of paper, foil, or other suitable substrates. In an embodiment of package 14 consistent with FIGS. 1–3, strip 10 is capable of receiving ink so that indicia 18 representing lottery or other information may be printed thereon. Strip 10 alternatively or additionally may be coated with thermally reactive, "scratch off," or other chemicals or coatings if desired. If "scratch off" or similar removable coatings or devices are used to mask indicia 18, strip 10 need not be opaque.

As shown in FIGS. 1–2, strip 10 comprises four panels 22A-D of equal size. Panels 22A-D include respective inner surfaces 24A-D and outer surfaces 25A-D, with inner surfaces 24AD defined as those visible in FIG. 1. Fold line 26 separates adjacent panels 22A and 22B, while fold line 30 separates adjacent panels 22B and 22C. Adjacent panels 22C and 22D are separated by fold line 34. Folding along each of fold lines 26, 30, and 34 causes its adjacent panels 22 to leave the plane of the page containing FIG. 1 and move toward the reader.

Each panel 22A-D also includes perforations, or lines of weakness 38, defining its central, or ticket, portion 42A-D. Tickets 42A-D each include corresponding inner surfaces 46A-D, which inner surfaces 46A-D are each coincident with a portion of respective inner surfaces 24A-D. Tickets 42A-D are designed for use with a lottery or to be promotional or other articles removable from package 14 after occurrence of a specific event (such as purchase of the package). For lottery tickets or promotional articles, inner surfaces 46A-D of tickets 42A-D typically will include indicia 18, which may, but in many cases will not, be identical for each ticket 42A-D.

FIGS. 1-2 detail adhesive 50 placed on inner surfaces 24B and 24C and outer surface 25A. Adhesive 50, which surrounds tickets 42A-C, permits surfaces of panels 22A-D to adhere, concealing indicia 18 as appropriate and decreasing the likelihood that indicia 18 could be revealed through tampering prior to purchase or other suitable event involving package 14. Adhesive 50 alternatively may be placed on inner surfaces 24A and 24D and outer surface 25D or, if one or more fold lines 26, 30, or 34 is modified, alternatively or additionally placed on other inner (24) or outer (25) surfaces.

FIG. 2 illustrates formation of package 14 from strip 10. Folding strip 10 along fold line 26 causes panel 22A to overlay adjacent panel 22B, with inner surfaces 24A and 24B facing each other. Folding (opaque) strip 10 in this manner causes ticket 42A to overlay and be aligned with adjacent ticket 42B as well, so that adjacent inner surfaces 46A and 46B face each other and conceal indicia 18 printed or otherwise contained thereon. Adhesive 50 (placed on panel 22B) causes panel 22B to adhere to adjacent panel 22A, further helping to conceal the indicia 18 and decrease the possibility of tampering until tickets 42A and 42B are removed concurrently from package 14.

Folding strip 10 along fold line 34 similarly causes panel 22D and ticket 42D to overlay adjacent panel 22C and ticket 42C, respectively. As folded in this manner, adjacent inner surfaces 46C and 46D too face and align with each other and conceal the indicia 18 contained thereon. Thus, in the present invention all of the indicia 18 contained on inner surface 46A-D may be concealed merely by folding along fold lines 26 and 34. Adhesive 50 placed on panel 22C causes it to adhere to panel 22D.

To complete formation of package 14 (FIG. 3), strip 10 then may be folded along fold line 30, causing panel 22A to overlay panel 22D with outer surfaces 25A and 25D in contact and tickets 42A-D to align. Adhesive 50 placed on outer surface 25A adheres it to outer surface 25*d*, forming integrated package 14. If outer surface 25B is nominally labelled the "front" of package 14 (as illustrated in FIG. 3 with promotional indicia 58), panels 22A-D are arranged so that 22B overlays panel 22A, panel 22A overlays panel 22D, and panel 22D overlays panel 22C. Knurling or crimping panels 22A-D provides an additional tamper-resistant fastening means 54 for package 14. Alternatively, some or all of adhesive 50 may be omitted if fastening means 54 is used.

Because tickets 42A-D are aligned in package 14, the tickets 42A-D may be removed simultaneously merely by tearing, or "punching out," their corresponding lines of weakness 38, which also are aligned. This action separates the lottery tickets or other articles comprising tickets 42A-D from the remainder of package 14, revealing the previously-concealed indicia 18 contained on inner surfaces 46A-D.

Figure 4:
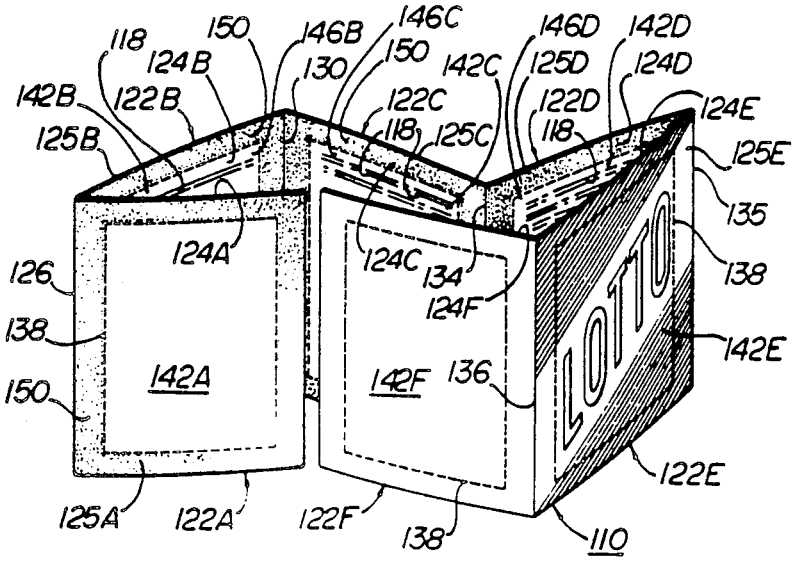
FIG. 4 is a perspective view of an alternate embodiment of the strip used to form the package of the present invention.

Illustrated in FIG. 4 is an alternate embodiment of the present invention. Strip 110 includes six panels 122A-F, each having respective inner surfaces 124A-F, outer surfaces 125A-F, and tickets 142A-F (each defined by lines of weakness 138 and having inner surfaces 146A-F bearing indicia 118). The interconnection of pairs of adjacent panels 122 and fold lines 126, 130, 134, 135, and 136 is as follows:

| Fold line | Connects adjacent panels |
|---|---|
| 126 | 122A and 122B |
| 130 | 122B and 122C |
| 134 | 122C and 122D |
| 135 | 122D and 122E |
| 136 | 122E and 122F |

As shown in FIG. 4, adhesive 150, placed on inner surfaces 124B-D and outer surface 125A, surrounds tickets 142A-D. Panel 122A initially may be folded along fold line 126 so as to overlay and adhere to panel 122B and conceal indicia 118 on inner surfaces 146A and 146B of tickets 142A and 142B. Folding strip 110 along fold line 135 then overlays panels 122B and 122C, respectively, with panels 122F and 122E and causes them to adhere, concealing indicia 118 contained on inner surfaces 146C-F. Again, indicia 118 may thus be concealed in their entirety merely by folding along two fold lines, 126 and 135. Folding panels 122B and 122C along fold line 130 causes outer surfaces 125A and 125F to contact and adhere to each other. To complete the integrated package of this embodiment, adjacent panels 122C and 122D of strip 110 finally may be folded along fold line 134 (which operates in accordion fashion, opposite the other fold lines 126, 130, 135, and 136), adhering outer surfaces 125C and 125D. As with package 14, the package formed from strip 110 may then be crimped, knurled, or otherwise redundantly fastened as appropriate or if additional security from tampering is desired.

Those ordinarily skilled in the art will recognize that many of the steps used to form the integrated packages of the present invention may be performed in any order. Lines of weakness 38 and 138, for example, may be created after the packages are formed, permitting a single blade or cutting mechanism to score all of the panels 22A-D or 122A-F simultaneously. Scoring in this manner assures proper alignment of the lines of weakness 38 and 138, facilitating the simultaneous tearing, or "punching out," of the respective tickets 42A-D and 142A-F.

Persons having ordinary skill in the art also will recognize that lines of weakness 38 or 138 may be created to form tickets 42 or 142 of virtually any shape, including but not limited to the rectangular tickets 42 and 142 illustrated in FIGS. 1-4. More than one ticket 42 or 142 may be included as part of each panel 22 or 122, permitting the package to contain tickets 42 or 142 equal to any multiple of the number of panels 22 or 122 formed in strip 10 or 110. Similarly, additional pairs of (or single) panels may be included on a strip to increase the number of tickets contained in the package. As a result of these variables, an almost infinite number and variety of tickets may be available from the packages of the present invention. Additional modifications will be apparent to those having ordinary skill in the art and may be made without departing from the scope or spirit of the present invention.

What is claimed is:

1. A strip of opaque material comprising:

a. first, second, third, and fourth panels, each panel comprising:

i. an inner surface;

ii. an outer surface; and iii. lines of weakness completely defining a removable central portion having an inner surface coincident with a portion of the inner surface of its corresponding panel and bearing printed indicia;

b. a first fold line for connecting the first panel to the second panel;

c. a second fold line for connecting the second panel to the third panel; and d. a third fold line for connecting the third panel to the fourth panel;

at least one of the inner surfaces of the first and second panels comprising adhesive surrounding its corresponding central portion;

at least one of the inner surfaces of the third and fourth panels comprising adhesive surrounding its corresponding central portion;

at least one of the outer surfaces of the first and fourth panels comprising adhesive surrounding its corresponding central portion;

the first and second panels folded along the first fold line so that the inner surfaces of the first and second panels face and adhere to each other and the central portions of the first and second panels align, for concealing the indicia present on the inner surfaces of the central portions of the first and second panels;

the third and fourth panels folded along the third fold line so that the inner surfaces of the third and fourth panels face and adhere to each other and the central portions of the third and fourth panels align, for concealing the indicia present on the inner surfaces of the central portions of the third and fourth panels; and the second and third panels folded along the second fold line so that the outer surfaces of the second and third panels face and adhere to each other, the lines of weakness of the first and second panels overlay the lines of weakness of the third and fourth panels, and the central portions of the first, second, third, and fourth panels align, forming an integrated package adapted for removal of the central portions of the panels by concurrently perforating the overlaid lines of weakness defining the central portions and thereby revealing the concealed indicia.

2. A strip according to claim 1 in which portions of the first, second, third, and fourth panels other than the removable central portions are fastened by an action selected from the group consisting of knurling and crimping integrated package and prior to removal of the central portions of the panels.

3. A strip according to claim 2 in which the central portions of the first, second, third, and fourth panels are rectangular.

4. A strip according to claim 3 in which the opaque material is laminated foil.

5. A strip according to claim 4 in which the printed indicia on the inner surfaces of the central portions of each of the first, second, third, and fourth panels are not identical.

6. A strip according to claim 5 in which the central portions of the first, second, third, and fourth panels are lottery tickets.

7. A strip according to claim 6 in which the outer face of at least one of the second and third panels bears printed promotional indicia not concealed when the integrated package is formed.

8. A strip of opaque material comprising:

a. first, second, third, fourth, fifth, and sixth panels, each panel comprising:

i. an inner surface;

ii. an outer surface; and iii. lines of weakness completely defining a removable central portion having an inner surface coincident with a portion of the inner surface of its corresponding panel and bearing printed indicia for use as a lottery ticket;

b. a first fold line for connecting the first panel to the second panel;

c. a second fold line for connecting the second panel to the third panel;

d. a third fold line for connecting the third panel to the fourth panel;

e. a fourth fold line for connecting the fourth panel to the fifth panel; and f. a fifth fold line for connecting the fifth panel to the sixth panel;

at least one of the inner surfaces of the first and second panels comprising adhesive surrounding its corresponding central portion;

at least one of the inner surfaces of the third and sixth panels comprising adhesive surrounding its corresponding central portion;

at least one of the inner surfaces of the fourth and fifth panels comprising adhesive surrounding its corresponding central portion;

at least one of the outer surfaces of the third and fourth panels comprising adhesive surrounding its corresponding central portion;

at least one of the outer surfaces of the first and sixth panels comprising adhesive surrounding its corresponding central portion;

the first and second panels folded along the first fold line so that the inner surfaces of the first and second panels face and adhere to each other and the central portions of the first and second panels align, for concealing the indicia present on the inner surfaces of the central portions of the first and second panels;

the fourth and fifth panels folded along the fourth fold line so that the inner surfaces of the fourth and fifth panels face and adhere to each other, the central portions of the fourth and fifth panels align, the inner surfaces of the third and sixth panels face and adhere to each other, and the central portions of the third and sixth panels align, for concealing the indicia present on the inner surfaces of the central portions of the third, fourth, fifth, and sixth panels; and the third and fourth panels folded along the third fold line so that the outer surfaces of the third and fourth panels face and adhere to each other and the central portions of the third, fourth, fifth, and sixth panels align; and the second and third panels folded along the second fold line so that the outer surfaces of the first and sixth panels face and adhere to each other, the lines of weakness of the first and second panels overlay the lines of weakness of the third, fourth, fifth, and sixth panels, and the central portions of the first, second, third, fourth, fifth, and sixth panels align, forming an integrated package adapted for removal of the central portions of the panels by concurrently perforating the overlaid lines of weakness defining the central portions and thereby revealing the concealed indicia.

9. A method for forming a package from a strip of opaque material comprising first, second, third, and fourth panels, each panel having an inner and an outer surface, comprising the steps of:

a. forming first, second, and third fold lines in the material, with the first fold line connecting the first panel to the second panel, the second fold line connecting the second panel to the third panel, and the third fold line connecting the third panel to the fourth panel;

b. forming lines of weakness in each of the first, second, third, and fourth panels completely defining in each panel a removable central portion having an inner surface coincident with a portion of the inner surface of its corresponding panel and bearing printed indicia;

c. placing adhesive on at least one of the inner surfaces of the first and second panels surrounding its corresponding central portion;

d. placing adhesive on at least one of the inner surfaces of the third and fourth panels surrounding its corresponding central portion;

e. placing adhesive on at least one of the outer surfaces of the first and fourth panels surrounding its corresponding central portion;

f. folding the first and second panels along the first fold line so that the inner surfaces of the first and second panels face and adhere to each other and the central portions of the first and second panels align, for concealing the indicia present on the inner surfaces of the central portions of the first and second panels;

g. folding the third and fourth panels along the third fold line so that the inner surfaces of the third and fourth panels face and adhere to each other and the central portions of the third and fourth panels align, for concealing the indicia present on the inner surfaces of the central portions of the third and fourth panels; and h. folding the second and third panels along the second fold line so that the outer surfaces of the second and third panels face and adhere to each other, the lines of weakness of the first and second panels overlay the lines of weakness of the third and fourth panels, and the central portions of the first, second, third, and fourth panels align, for forming an integrated package adapted for removal of the central portions of the panels by concurrently perforating the overlaid lines of weakness defining the central portions and thereby revealing the concealed indicia.

10. A method according to claim 9 further comprising the step of crimping the first, second, third, and fourth panels following formation of the integrated package and prior to removal of the central portions of the panels.

11. A method according to claim 9 further comprising the step of knurling the first, second, third, and fourth panels following formation of the integrated package and prior to removal of the central portions of the panels.

12. A strip of opaque material comprising:

a. first, second, third, and fourth panels, each panel comprising:

i. an inner surface;

ii. an outer surface; and iii. lines of weakness completely defining a removable central portion having an inner surface coincident with a portion of the inner surface of its corresponding panel and bearing printed indicia;

b. a first fold line for connecting the first panel to the second panel;

c. a second fold line for connecting the second panel to the third panel; and d. a third fold line for connecting the third panel to the fourth panel;

the first and second panels folded along the first fold line so that the inner surfaces of the first and second panels face each other and the central portions of the first and second panels align, for concealing the indicia present on the inner surfaces of the central portions of the first and second panels;

the third and fourth panels folded along the third fold line so that the inner surfaces of the third and fourth panels face each other and the central portions of the third and fourth panels align, for concealing the indicia present on the inner surfaces of the central portions of the third and fourth panels;

the second and third panels folded along the second fold line so that the outer surfaces of the second and third panels face each other, the lines of weakness of the first and second panels overlay the lines of weakness of the third and fourth panels, and the central portions of the first, second, third, and fourth panels align; and the first, second, third, and fourth panels of the integrated package fastened for forming an integrated package prior to removal of the central portions of the panels, which integrated package is adapted for removal of the central portions of the panels by concurrently perforating the overlaid lines of weakness defining the central portions and thereby revealing the concealed indicia.

13. A strip according to claim 12 in which the first, second, third, and fourth panels are fastened by an action selected from the group consisting of knurling and crimping.

* * * * *

UNITED STATES PATENT AND TRADEMARK OFFICE

CERTIFICATE OF CORRECTION

PATENT NO. : 5,125,689

DATED : June 30, 1992

INVENTOR(S) : Byrne E. Heninger

It is certified that error appears in the above-identified patent and that said Letters Patent is hereby corrected as shown below:

Column 2, line 5, delete "area" and insert --areas--

Column 2, line 62, delete "24AD" and insert --24A-D--

Column 5, lines 58-59, delete "integrated package and prior to removal of the central portions of the panels"

Signed and Sealed this

Seventh Day of September, 1993

Bruce Lehman

*Attest:*

BRUCE LEHMAN

*Attesting Officer*

*Commissioner of Patents and Trademarks*